US007832808B2

(12) United States Patent
Hall et al.

(10) Patent No.: US 7,832,808 B2
(45) Date of Patent: Nov. 16, 2010

(54) TOOL HOLDER SLEEVE

(76) Inventors: David R. Hall, 2185 S. Larsen Pkwy., Provo, UT (US) 84606; Ronald Crockett, 2185 S. Larsen Pkwy., Provo, UT (US) 84606; Jeff Jepson, 2185 S. Larsen Pkwy., Provo, UT (US) 84606

( * ) Notice: Subject to any disclaimer, the term of this patent is extended or adjusted under 35 U.S.C. 154(b) by 314 days.

(21) Appl. No.: 11/928,471

(22) Filed: Oct. 30, 2007

(65) Prior Publication Data

US 2009/0108664 A1 Apr. 30, 2009

(51) Int. Cl.
*E21C 35/19* (2006.01)

(52) U.S. Cl. ..... 299/104; 299/106

(58) Field of Classification Search ..... 299/102, 299/104, 105, 106, 107, 111, 113
See application file for complete search history.

(56) References Cited

U.S. PATENT DOCUMENTS

| | | | |
|---|---|---|---|
| 2,004,315 | A | 6/1935 | Fean |
| 2,124,438 | A | 7/1938 | Struk |
| 3,254,392 | A | 6/1966 | Novkov |
| 3,746,396 | A | 7/1973 | Radd |
| 3,807,804 | A | 4/1974 | Kniff |
| 3,830,321 | A | 8/1974 | McKenry |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |
| 4,098,362 | A | 7/1978 | Bonnice |
| 4,109,737 | A | 8/1978 | Bovenkerk |
| 4,156,329 | A | 5/1979 | Daniels |
| 4,199,035 | A | 4/1980 | Thompson |
| 4,201,421 | A | 5/1980 | Den Besten |
| 4,277,106 | A | 7/1981 | Sahley |
| 4,439,250 | A | 3/1984 | Acharya |
| 4,465,221 | A | 8/1984 | Schmidt |
| 4,484,644 | A | 11/1984 | Cook |
| 4,489,986 | A | 12/1984 | Dziak |
| 4,678,237 | A | 7/1987 | Collin |
| 4,682,987 | A | 7/1987 | Brady |
| 4,688,856 | A | 8/1987 | Elfgen |
| 4,725,098 | A | 2/1988 | Beach |
| 4,729,603 | A | 3/1988 | Elfgen |
| 4,765,686 | A | 8/1988 | Adams |
| 4,765,687 | A | 8/1988 | Parrott |
| 4,776,862 | A | 10/1988 | Wiand |
| 4,880,154 | A | 11/1989 | Tank |
| 4,932,723 | A | 6/1990 | Mills |
| 4,940,288 | A | 7/1990 | Stiffler |
| 4,944,559 | A | 7/1990 | Sionnet |
| 4,951,762 | A | 8/1990 | Lundell |
| 5,011,515 | A | 4/1991 | Frushour |

(Continued)

*Primary Examiner*—John Kreck
(74) *Attorney, Agent, or Firm*—Tyson J. Wilde; Philip W. Townsend, III

(57) ABSTRACT

In one aspect of the present invention, a degradation assembly has a holder fitted within a block attached to a driving mechanism. The holder has a longitudinal central bore with an opening at an end opposite the driving mechanism. A high impact resistant tool has a carbide bolster axially intermediate a steel shank and an impact tip, the steel shank having a first end and a second end. A sleeve being radially intermediate the bore of the holder and the steel shank.

18 Claims, 8 Drawing Sheets

U.S. PATENT DOCUMENTS 5,098,167 A * 3/1992 Latham ..... 299/104
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 * 4/2002 Sollami ..... 299/104
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,692,083 B2 2/2004 Latham
6,709,065 B2 3/2004 Peay
6,719,074 B2 4/2004 Tsuda
6,733,087 B2 * 5/2004 Hall et al. ..... 299/113
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,889,890 B2 5/2005 Yamazaki
6,966,611 B1 11/2005 Sollami
6,994,404 B1 2/2006 Sollami
7,204,560 B2 4/2007 Mercier
7,387,345 B2 * 6/2008 Hall et al. ..... 299/79.1
7,387,465 B2 * 6/2008 Hall et al. ..... 404/94
7,390,066 B2 * 6/2008 Hall et al. ..... 299/81.1
7,410,221 B2 * 8/2008 Hall et al. ..... 299/107
7,413,258 B2 * 8/2008 Hall et al. ..... 299/111
7,469,971 B2 * 12/2008 Hall et al. ..... 299/79.1
7,475,948 B2 * 1/2009 Hall et al. ..... 299/104
7,600,823 B2 * 10/2009 Hall et al. ..... 299/106
7,635,168 B2 * 12/2009 Hall et al. ..... 299/104
7,637,574 B2 * 12/2009 Hall et al. ..... 299/111
2002/0175555 A1 11/2002 Mercier
2003/0141350 A1 7/2003 Noro
2003/0209366 A1 * 11/2003 McAlvain ..... 175/427
2003/0234280 A1 12/2003 Cadden
2004/0026983 A1 * 2/2004 McAlvain ..... 299/111
2004/0065484 A1 4/2004 McAlvain
2005/0159840 A1 7/2005 Lin
2005/0173966 A1 8/2005 Mouthaan
2006/0237236 A1 10/2006 Sreshta

* cited by examiner

TOOL HOLDER SLEEVE

BACKGROUND OF THE INVENTION

Formation degradation, such as asphalt milling, mining, or excavating, may result in wear on attack tools. Consequently, many efforts have been made to efficiently remove and replace these tools.

U.S. Pat. No. 6,371,567 to Sollami, which is herein incorporated by reference for all that it contains, discloses a bit holder with its mating bit block utilizing a slight taper in the bit block bore, and a tapered shank on the bit holder that includes a second larger diameter tapered distal segment that combines with an axially oriented slot through the side wall of the bit holder shank to allow a substantially larger interference fit between the distal tapered shank segment and the bit block bore than previously know. When inserting the bit holder in the bit block bore, the distal first tapered segment resiliently collapses to allow insertion of that segment into the bit block bore. A second shank tapered portion axially inwardly of the first distal tapered portion and separated therefrom by a shoulder provides a space between the bit block bore and the second tapered shank portion until the upper ⅛ to ½ inch of the second tapered shank portion meets and again forms an interference fit with the bit block bore at a portion of the shank above a termination of the slot therethrough. The dual tapered shank allows the insertion of the bit holder in the bit block with an interference fit that provides a secure mounting of the bit holder in the bit block. Since there is no fastener to maintain the bit holder in the bit block, it may be removed from the bit block by driving the base of the bit holder out of the bit block.

U.S. Pat. No. 7,210,744 to Montgomery, Jr., which is herein incorporated by reference for all that it contains, discloses a wear sleeve comprising a rearward split ring portion and an intermediate cylindrical ring portion adjacent a forward shoulder portion. The outer diameter of the wear sleeve intermediate portion and rearward split ring portion is uniform. The wear sleeve is inserted into the bit holder's stepped bore aperture. The split ring portion is radially compressed by the smaller diameter opposite portion end as the sleeve is hammered and axially displaced into the bit holder. The split ring portion forms frictional contact with the opposite end portion of the aperture. The wear sleeve friction fit can b easily removed manually in the field. The bit holder and cooperation support block are designed to limit the amount of relative yaw between the two members during operation to reduce the overall wear there between. The invention includes a groove having side surfaces that are inclined at least 15 degrees with respect to the horizontal axis and the cutting bit is positioned more apt toward the central axis of the support block than prior art designs.

BRIEF SUMMARY OF THE INVENTION

In one aspect of the present invention, a degradation assembly has a block attached to a driving mechanism. A holder is fit within a longitudinal central bore of the block, which bore has an opening at an end opposite the driving mechanism. A high impact resistant tool has a carbide bolster intermediate a steel shank and an impact tip, the steel shank having a first end and a second end. The second end of the steel shank is fit into a central bore of a sleeve which may have a threadform about its outside diameter. The threadform may be adapted to attach to an inside diameter of the holder. The steel shank may be adapted to rotate within the sleeve. The threadform of the sleeve may be tapered.

In some embodiments, the first end of the steel shank may be press-fit into a bore of the carbide bolster. In other embodiments, the carbide bolster may be attached to an enlarged portion of the shank. A carbide stem may be formed at a base of the carbide bolster and may be press-fit into a bore formed in the enlarged portion. The carbide bolster may also be press-fit within a bore of the enlarged portion.

A first and second seal may be disposed near the first and second ends of the steel shank. The seals may be radially intermediate the shank and the central bore of the sleeve. An enclosed region axially intermediate the first and second seals and radially intermediate the steel shank and the sleeve may be in fluid communication with a pressurized lubricant reservoir. The lubricant reservoir may have a lubricant selected from the group consisting of grease, petroleum products, vegetable oils, mineral oils, graphite, hydrogenated polyolefin, esters, silicone, fluorocarbons, molybdenum disulfide, or combinations thereof. The lubricant reservoir may also have a compression mechanism selected from the group consisting of springs, coiled springs, foam, closed-cell foam, compressed gas, wave springs, or combinations thereof. The lubricant may be adapted to exert a force on the tool in a direction toward the second end of the shank.

The sleeve may have a shoulder portion adapted to abut a base of a carbide bolster or an enlarged portion of the shank of the tool. A underside of the shoulder portion of the sleeve may be tapered. The shoulder may also comprise a gripping feature along its outer diameter such as a non-circular geometry, a pinhole, a notch, or combinations thereof. The shoulder portion may also have a stabilizing feature such as an annular groove which is adapted to fit within an annular protrusion of the base or enlarged portion which may radially stabilize the carbide bolster while still allowing rotation.

The impact tip may comprise a superhard material bonded to a cemented metal carbide substrate at a non-planar interface. The superhard material may have a substantially pointed geometry with an apex comprising a 0.050 to 0.200 inch radius, and a 0.100 to 0.500 inch thickness from the apex to the non-planar interface. The superhard material may comprise polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof.

In another aspect of the present invention, the threadform of the sleeve is coupled with a threadform of an insert press-fit into the longitudinal central bore of the holder.

DETAILED DESCRIPTION OF THE INVENTION AND THE PREFERRED EMBODIMENT

Figure 1:
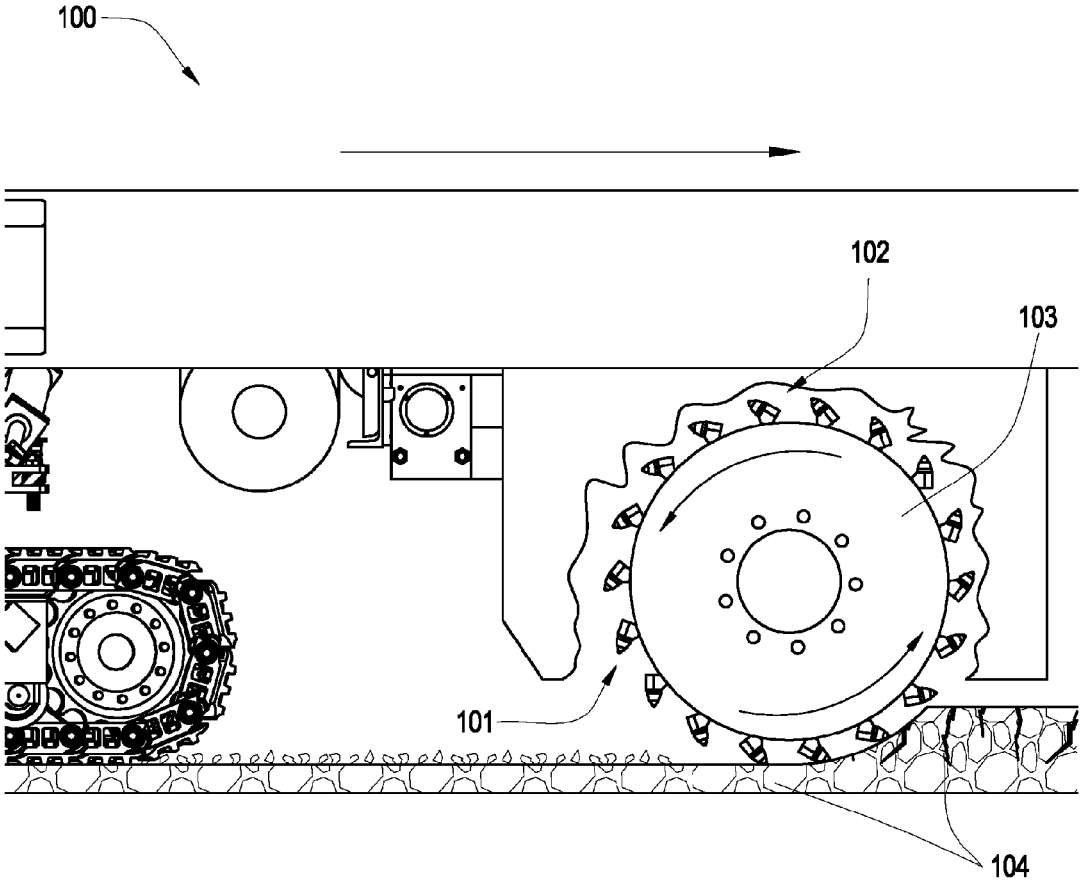
FIG. 1 is a cross-sectional diagram of an embodiment of a plurality of tools on a rotating drum attached to a motor vehicle.

FIG. 1 is a cross-sectional diagram of an embodiment of a plurality of tools 101 attached to a rotating drum 103 connected to the underside of a pavement recycling machine 100. The recycling machine 100 may be a cold planer used to degrade man-made formations 104 such as pavement. Tools 101 may be inserted into a sleeve, the sleeve being fit within a holder 102. The holder 102 being fit within a block that is attached to the rotating drum 103. The holder 102 may hold the sleeve, and thereby the tool, at an angle offset from the direction of rotation, such that the tool 101 engages the pavement at a preferential angle. The tool 101 may be rotationally fixed to the rotating drum 103.

Figure 2:
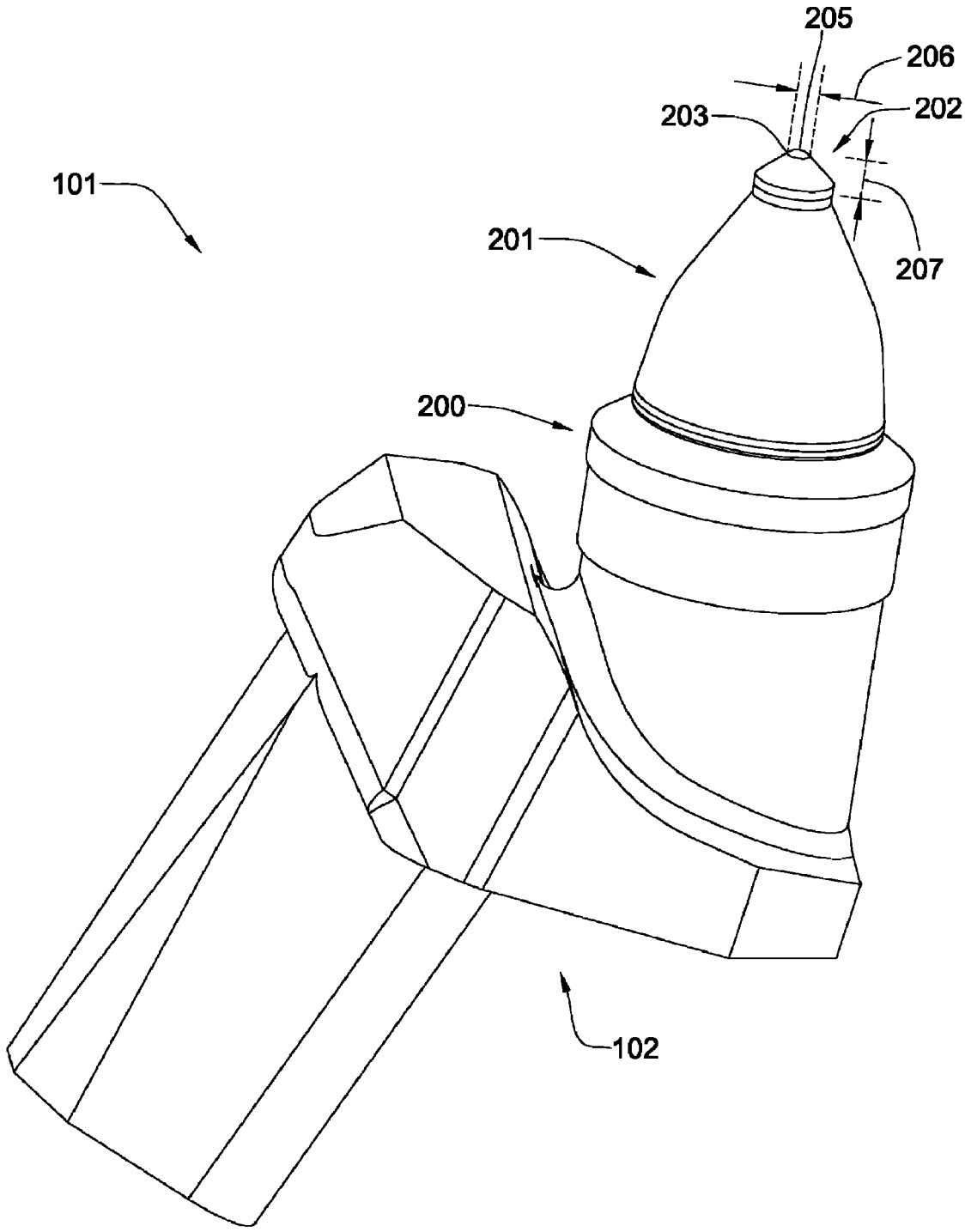
FIG. 2 is a perspective diagram of an embodiment of a tool.

FIG. 2 illustrates an embodiment of a tool 101 disposed in a sleeve 200. The sleeve 200 is inserted into a holder 102. The high impact resistant tool 101 comprises a carbide bolster 201 intermediate a steel shank and an impact tip 202; the steel shank being inserted into the sleeve 200. The impact tip 202 may comprise a superhard material 203 bonded to a cemented metal carbide substrate 204 at a non-planar interface. The superhard material 203 may have a substantially pointed geometry with an apex 205 comprising a 0.050 to 0.200 inch radius 206, and a 0.100 to 0.500 inch thickness 207 from the apex 205 to the non-planar interface. The superhard material may comprise polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. The holder 102 may comprise an asymmetric geometry as such the Wirtgen HT11 Holder.

Figure 3:
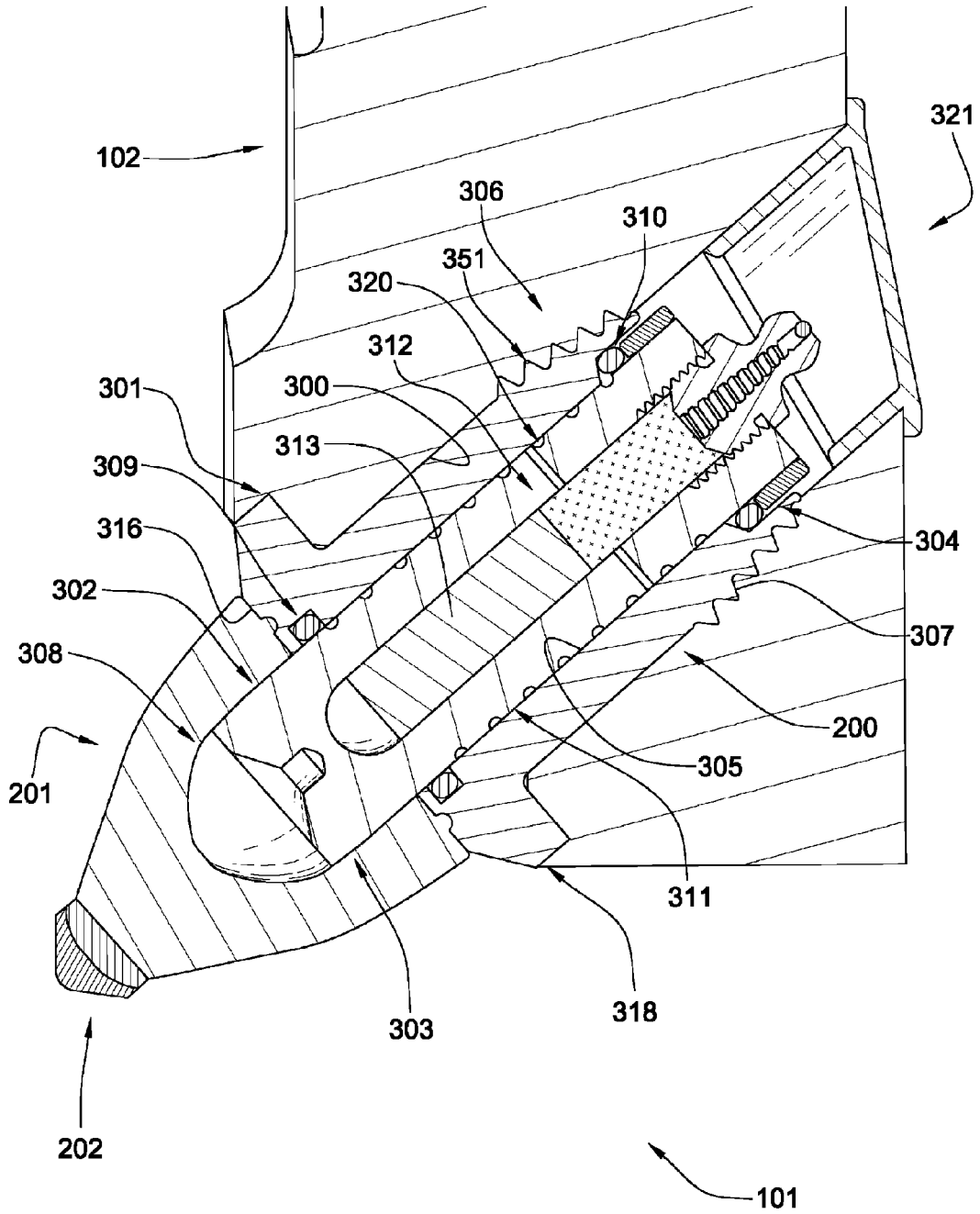
FIG. 3 is a cross-sectional diagram of an embodiment of a tool disposed in a sleeve.

Referring now to FIG. 3, a holder 102 is attached to a block which is attached to the driving mechanism. The holder 102 comprises a longitudinal central bore 300 having an opening 301 at an end opposite the driving mechanism. The high impact resistant tool 101 comprises a carbide bolster 201 intermediate a steel shank 302 and an impact tip 202. The steel shank 302 has a first end 303 and a second end 304; the second end 304 being fit into a central bore 305 of a sleeve 200. The sleeve 200 comprises a threadform 306 about its outside diameter which is coupled with a threadform 307 formed in an inside diameter of the longitudinal central bore 300 of the holder 102. In some embodiments, the threadform 306 may be tapered. Also, in some embodiments the threadform 306 may comprise relatively course threads 351. A tapered threadform may be beneficial by decreasing the time required to replace the sleeve and tool in the holder. A tapered threadform may allow for fewer rotations needed to completely mate the two threadforms. It is also believed that a tapered threadform may more evenly distribute forces exerted along the sleeve during operation. The steel shank 302 may be adapted to rotate within the sleeve 200. In some embodiment, the first end 303 of the steel shank 302 may be press-fit into a bore 308 of the carbide bolster 201.

A first seal 309 and a second seal 310 may be disposed near the first and second ends 303, 304, of the steel shank 302 and be radially intermediate the shank 302 and the central bore 305 of the sleeve 200. An enclosed region 311 between the first and second seals 309, 310 may be in fluid communication with a pressurized lubricant reservoir 312. The lubricant reservoir 312 may comprise a lubricant selected from the group consisting of grease, petroleum products, vegetable oils, mineral oils, graphite, hydrogenated polyolefin, esters, silicone, fluorocarbons, molybdenum disulfide, or combinations thereof. In this embodiment, the lubricant reservoir 312 may comprise a closed-cell foam compression mechanism 313. In other embodiments, the lubricant reservoir may comprise a compression mechanism selected from the group consisting of springs, coiled springs, compressed gas, wave springs, or combinations thereof. The lubricant may be adapted to exert a force on the tool 101 in a direction, indicated by an arrow 314, toward the second end 304 of the steel shank 302. The force may be beneficial for holding the tool 101 snugly within the bore 305 of the sleeve 200.

A shoulder portion 318 of the sleeve may be intermediate the opening 301 of the longitudinal central bore 300 of the holder 102 and a base of the carbide bolster. In this embodiment, the shoulder portion 318 of the sleeve 200 and the base of the bolster of the tool 101 may abut each other. However, in other embodiments, the shoulder portion and the base may not be in contact with each other. In some embodiment, the steel shank 302 may also comprise a recess 320 about its outer diameter to accommodate lubricant distribution along the shank 302. The recess 320 may comprise a spiral groove, cross-hatching, or a combination thereof. Also in this embodiment, a cap 321 may be fitted on the second end 304 of the steel shank 302, the cap 321 being adapted for keeping dirt out of the lubricant reservoir 312.

Figure 4:
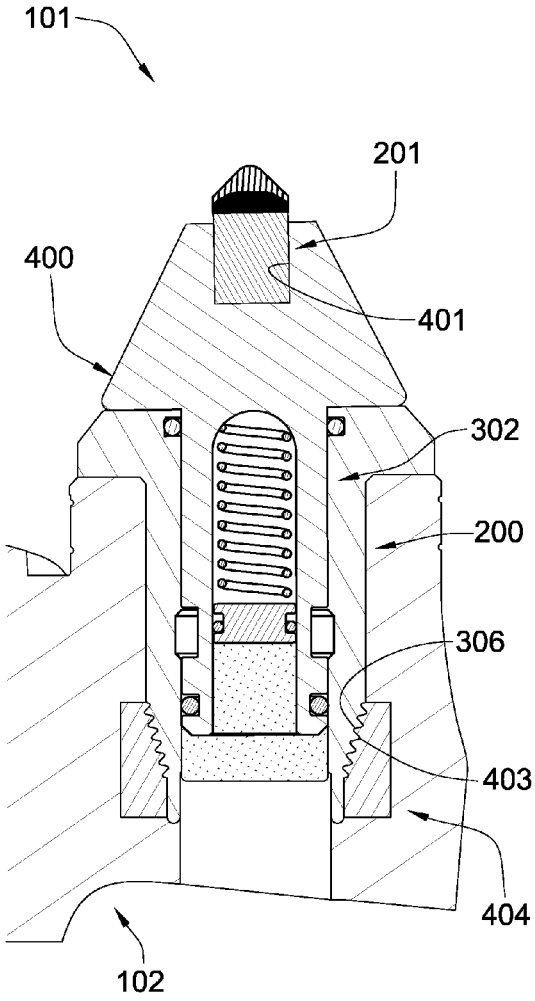
FIG. 4 is a cross-sectional diagram of another embodiment of a tool disposed in a sleeve.

FIG. 4 shows another embodiment of a tool 101 disposed in a sleeve 200. In this embodiment, the carbide bolster 201 may be attached to an enlarged portion 400 of the shank. More particularly, the carbide bolster 201 may be press-fit into a bore 401 formed in the enlarged portion 400. The lubricant reservoir 312 may comprise a coiled spring compression mechanism 402. In some embodiments, the threadform 306 of the sleeve 200 may be coupled with a threadform 403 of an insert 404 press-fit into the longitudinal central bore 300 of the holder 102.

Figure 5:
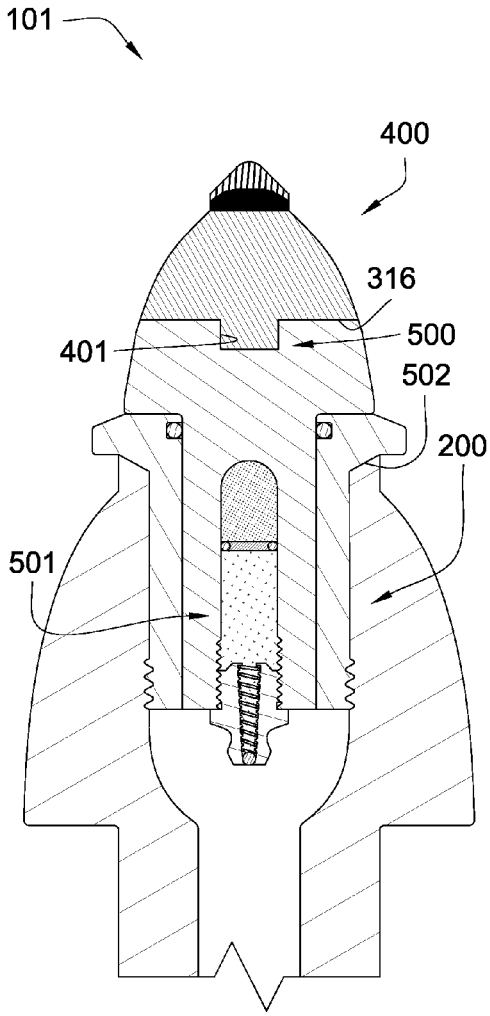
FIG. 5 is a cross-sectional diagram of another embodiment of a tool disposed in a sleeve.

FIG. 5 discloses another tool 101 disposed in a sleeve 200. In this embodiment, a carbide stem 500 formed at the base of the carbide bolster 316 may be press-fit into the bore 401 of the enlarged portion 400. The lubricant reservoir 312 illustrated in this diagram may comprise a compressed gas compression mechanism 501. In this embodiment, a base 502 of the shoulder portion 318 of the sleeve 200 may be tapered. Also, the holder may have a substantially symmetric geometry, such as standard holders provided by Sollami and Kennametal.

Figure 6:
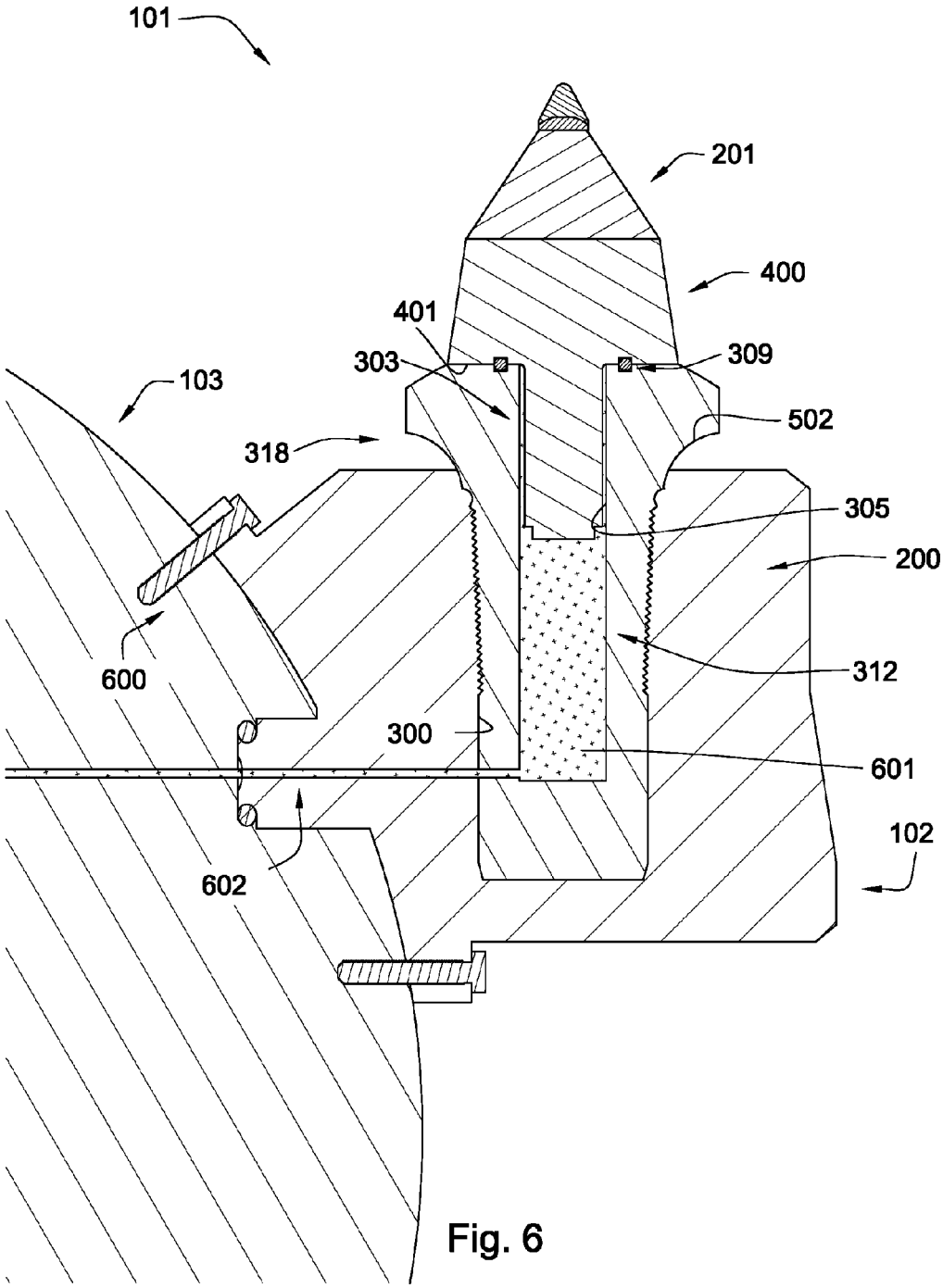
FIG. 6 is a cross-sectional diagram of another embodiment of a tool disposed in a sleeve.

Referring now to FIG. 6, a block may be attached to a rotating drum 103 using bolts 600. In this embodiment, the sleeve may be fit directly into a bore of the block verses being fit into a holder which is fit within a block. The carbide bolster 201 may be attached to the enlarged portion 400. As the tool 101 engages a formation during operation, the tool 101 may be adapted to rotate within the bore 305 of the sleeve 200. This rotation is believed to cause the tool 101 to wear evenly and extend the life of the tool 101. Lubricant 601 from the lubricant reservoir 312 may further facilitate low-friction rotation of the tool 101. The lubricant 601 may be substantially retained within the bore 305 of the sleeve by the first seal 309 near the first end 303 of the steel shank 302. The first seal 309 may be an o-ring seal disposed intermediate the base 401 of the steel body 400 and the shoulder portion 318 of the sleeve 200. More lubricant 601 may enter the bore 305 of the sleeve through a radial channel 602; the radial channel 602 originating from the rotating drum 103. In this embodiment, the steel shank 203 may be solid. Also, the threadform 306 of the outer diameter of the sleeve 200 may extend along a majority of the longitudinal central bore 300 of the holder 102. The base 502 of the shoulder portion 318 of the sleeve 200 may comprise a concave geometry.

Figure 7:
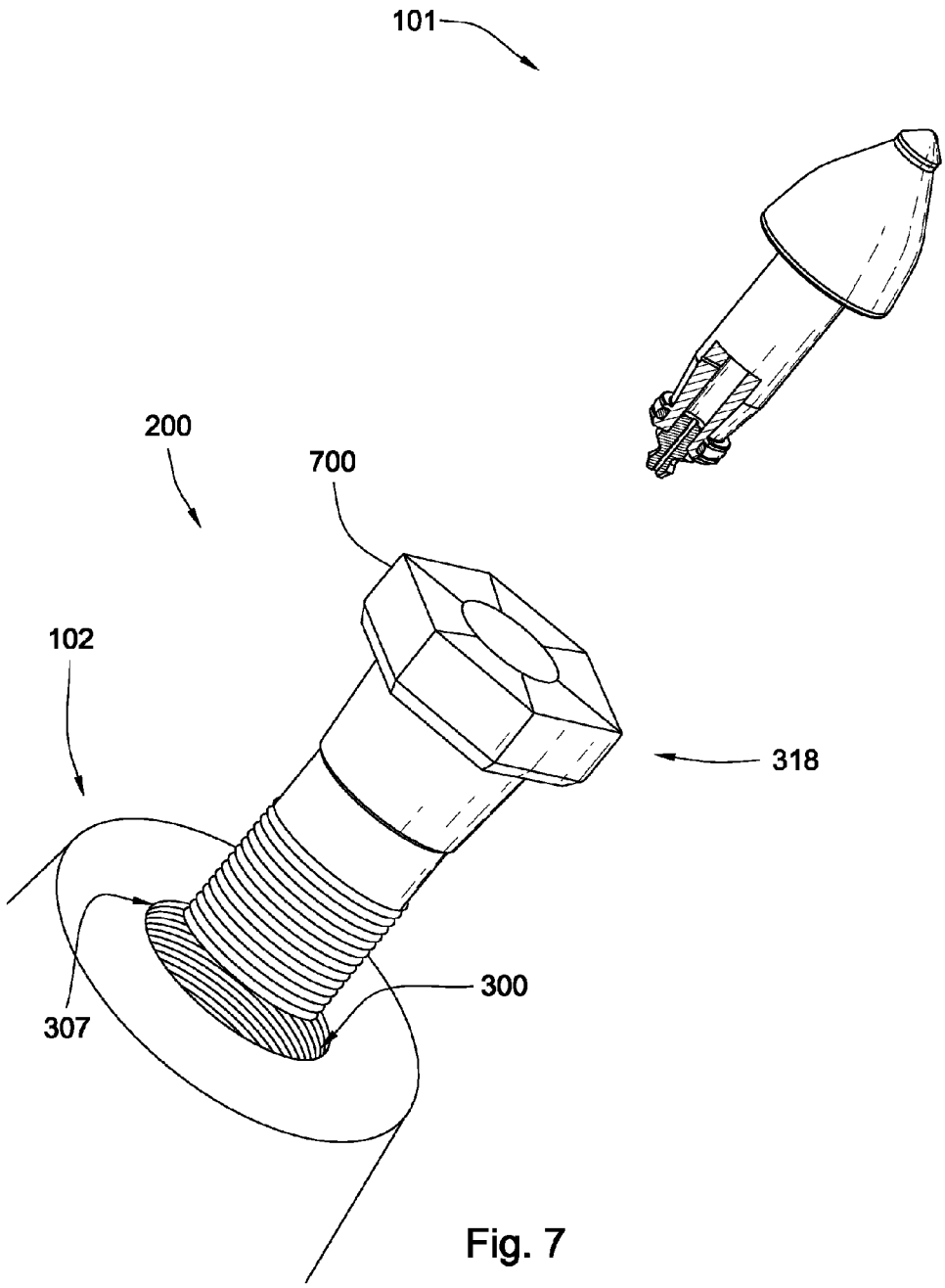
FIG. 7 is an exploded diagram of another embodiment of a tool.

FIG. 7 discloses an exploded diagram of an embodiment of a tool 101, a sleeve 200, and a holder 102. The outside diameter of the sleeve 200 comprises a threadform 306 adapted to mate with a threadform 307 of the central bore 300 of the holder 102. The shoulder portion 318 of the sleeve 200 may have a gripping feature 700 along its outer diameter. In this embodiment, the gripping feature 700 may comprise a non-circular geometry; more particularly, a geometry incorporating wrench flats. The extraction tool may be adapted to grip the outer diameter of the shoulder portion and rotate it so that the threadform 306 of the sleeve 200 may be unscrewed from or screwed into the threadform 307 of the holder.

Figure 8:
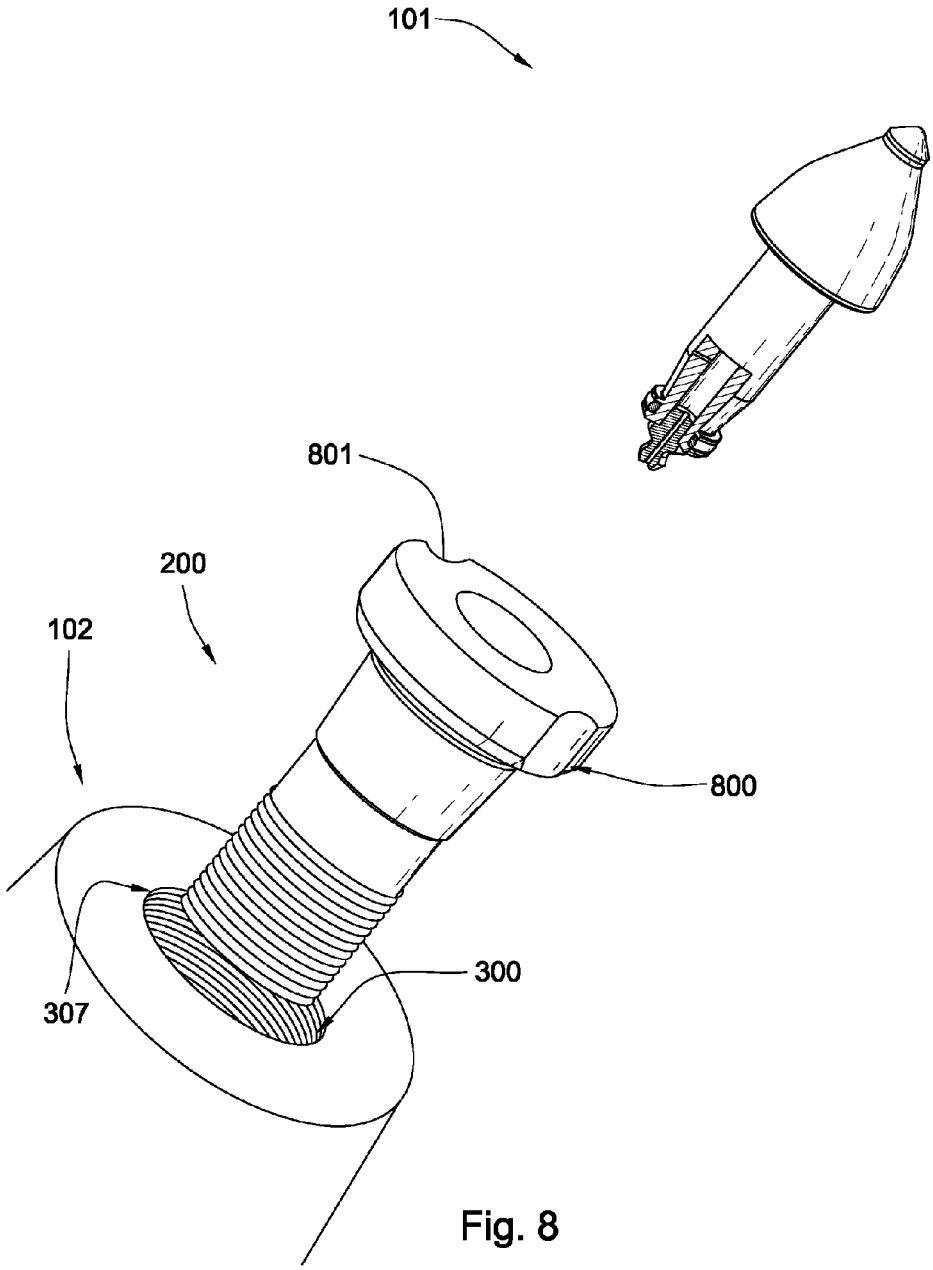
FIG. 8 is an exploded diagram of another embodiment of a tool.

FIG. 8 discloses an exploded diagram of another embodiment of a tool 101, a sleeve 200, and a holder 102. In this embodiment, the shoulder portion 318 of the sleeve 200 may have a gripping feature 800 comprising at least one notch 801, such that an extraction tool may comprise ridges or pins adapted to fit within the at least one notch 801; wherein as the extraction tool rotates, the threadform 306 of the sleeve 200 may be quickly unscrewed from or screwed into the threadform 307 of the central bore 300 of the holder 102.

Figure 9:
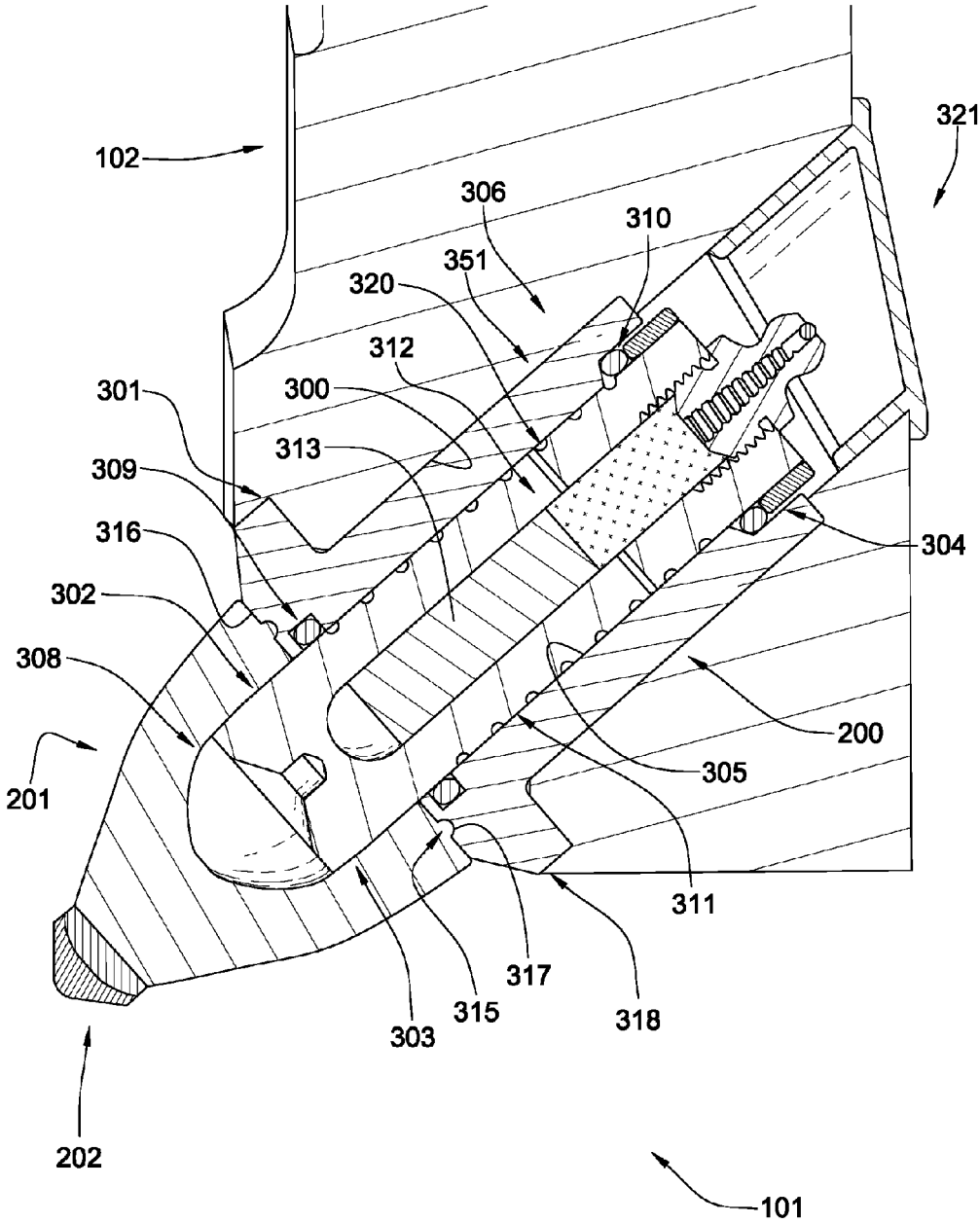
FIG. 9 is a cross-sectional diagram of another embodiment of a tool disposed in a sleeve.

Now referring to FIG. 9, this embodiment discloses a sleeve with a straight outer diameter which is press fit into the bore of the holder. In this embodiment, the carbide bolster 201 may comprise an annular protrusion 315 along its base 316 adapted to mate with an annular groove 317 formed in a shoulder portion 318 of the sleeve 200. The ridge 315 mated with the groove 317 may be beneficial in stabilizing the tool 101 held within the sleeve 200 during operation.

Whereas the present invention has been described in particular relation to the drawings attached hereto, it should be understood that other and further modifications apart from those shown or suggested herein, may be made within the scope and spirit of the present invention.

What is claimed is:

1. A degradation assembly, comprising:

a holder fitted within a block attached to a driving mechanism, the holder comprising a longitudinal central bore having an opening at an end opposite the driving mechanism;

a high impact resistant tool comprising a carbide bolster axially intermediate a steel shank and an impact tip, the steel shank having a first end and a second end;

a sleeve being radially intermediate the bore of the holder and the steel shank;

a first seal and a second seal are respectively disposed near the first and second ends of the steel shank intermediate the shank and the central bore of the sleeve;

an enclosed region intermediate the first and second seals and intermediate the steel shank and the sleeve is in fluid communication with a pressurized lubricant reservoir; and a recess formed about an outer diameter of the shank that accomodates a lubricant of the lubricant reservior.

2. The assembly of claim 1, wherein the sleeve comprises a threadform about its outside diameter and the threadform of the sleeve is coupled with a threadform formed in an inside diameter of the longitudinal central bore of the holder.

3. The assembly of claim 2, wherein the threadform of the sleeve is tapered.

4. The assembly of claim 1, wherein the first end of the steel shank is press-fit into a bore of the carbide bolster.

5. The assembly of claim 1, wherein the carbide bolster is attached to a steel body, the steel body being connected to the steel shank.

6. The assembly of claim 5, wherein a carbide stem formed at a base of the carbide bolster is press-fit into a bore formed in the steel body.

7. The assembly of claim 5, wherein the carbide bolster is press-fit within a bore of the steel body.

8. The assembly of claim 1, wherein the lubricant reservoir comprises a compression mechanism selected from the group consisting of springs, coiled springs, foam, closed-cell foam, compressed gas, wave springs, or combinations thereof

9. The assembly of claim 1, wherein lubricant is adapted to exert a force on the tool in a direction toward the second end of the shank.

10. The assembly of claim 1, wherein a cap is fitted on the second end of the steel shank, the cap being adapted for protecting the lubricant reservoir from impurities.

11. The assembly of claim 1, wherein the sleeve comprises a shoulder portion intermediate the opening to the longitudinal central bore of the holder and an overhang of the tool.

12. The assembly of claim 11, wherein the shoulder portion of the sleeve and the carbide bolster of the tool contact each other.

13. The assembly of claim 11, wherein a base of the shoulder portion of the sleeve is tapered.

14. The assembly of claim 11, wherein the shoulder comprises a gripping feature along its outer diameter such as a non-circular geometry, a pinhole, a notch, or combinations thereof

15. The assembly of claim 1, wherein the impact tip comprises a superhard material bonded to a cemented metal carbide substrate at a non-planar interface.

16. The assembly of claim 15, wherein the superhard material comprises a substantially pointed geometry with an apex comprising a 0.050 to 0.200 inch radius, and a 0.100 to 0.500 inch thickness from the apex to the non-planar interface.

17. The assembly of claim 1, wherein the shank is press fit into the bore of the sleeve.

18. The assembly of claim 1, wherein the sleeve is press fit into the bore of the holder.

* * * * *